US005441156A

United States Patent [19]

Fabry et al.

[11] Patent Number: 5,441,156

[45] Date of Patent: Aug. 15, 1995

[54] PROCESS AND RECOVERING MINERALS FROM NON-SULFIDIC ORES BY FLOTATION

[75] Inventors: Bernd Fabry, Korschenbroich; Rita Koester, Duesseldorf; Hans-Christian Raths, Monheim; Frank Wangemann, Solingen; Heinz Mueller, Monheim, all of Germany

[73] Assignee: Henkel Kommanditgesellschaft auf Aktien, Duesseldorf, Germany

[21] Appl. No.: 150,117

[22] PCT Filed: May 20, 1992

[86] PCT No.: PCT/EP92/01120

§ 371 Date: Nov. 29, 1993

§ 102(e) Date: Nov. 29, 1993

[87] PCT Pub. No.: WO92/21443

PCT Pub. Date: Dec. 10, 1992

[30] Foreign Application Priority Data

May 29, 1991 [DE] Germany ..... 41 17 671.5

[51] Int. Cl.[6] ..... B03D 1/02; B03D 1/012

[52] U.S. Cl. ..... 209/166; 252/61; 241/20; 241/24

[58] Field of Search ..... 209/166, 167, 902, 3; 252/61; 241/20, 21, 24

[56] References Cited

U.S. PATENT DOCUMENTS

| | | | |
|---|---|---|---|
| 2,285,394 | 6/1942 | Coke . | |
| 2,385,054 | 9/1945 | Booth . | |
| 2,414,714 | 1/1947 | Booth et al. | 209/166 |
| 2,475,581 | 7/1949 | Booth . | |
| 2,477,402 | 7/1949 | Booth . | |
| 2,748,938 | 6/1956 | Bunge | 209/166 |
| 4,457,850 | 7/1984 | Tesmann et al. . | |

FOREIGN PATENT DOCUMENTS

| | | |
|---|---|---|
| 0108914 | 5/1984 | European Pat. Off. . |
| 1029761 | 5/1958 | Germany . |
| 1224676 | 9/1966 | Germany . |
| 3238060 | 4/1984 | Germany . |
| 3723323 | 1/1989 | Germany . |
| 3723826 | 1/1989 | Germany . |

(List continued on next page.)

OTHER PUBLICATIONS

H. Schubert, "Aufbereitung fester mineralischer Stoffe", Leipzig, 1967.

(List continued on next page.)

*Primary Examiner*—Thomas M. Lithgow

*Attorney, Agent, or Firm*—Wayne C. Jaeschke; Norvell E. Wisdom, Jr.; Patrick J. Span

[57] ABSTRACT

Minerals can be recovered by flotation from non-sulfidic ores by using detergent mixtures containing:

a) salts of sulfonation products of unsaturated fatty acids corresponding formula (I):

$$R^1C(O)—OH \quad (I)$$

in which $R^1CO$ is a linear or branched aliphatic acyl radical containing 12 to 24 carbon atoms and 1 to 5 double bonds, and b) salts of sulfonation products of unsaturated fatty acid glycerol esters corresponding to formula (II):

$$\begin{array}{l} CH_2O—C(O)R^2 \\ | \\ CH—O—C(O)R^3, \\ | \\ CH_2O—C(O)R^4 \end{array} \quad (II)$$

in which $R^2C(O)$ is a linear or branched aliphatic acyl radical containing 12 to 24 carbon atoms and 1 to 5 double bonds and $R^3C(O)$ and $R^4C(O)$ independently of one another represent a linear or branched aliphatic acyl radical containing 6 to 24 carbon atoms and 0 or 1 to 5 double bonds, and, optionally, other anionic and/or nonionic surfactants, as collectors.

20 Claims, No Drawings

FOREIGN PATENT DOCUMENTS

| | | |
|---|---|---|
| 3936001 | 10/1989 | Germany . |
| 4019713 | 6/1990 | Germany . |
| 0373667 | 6/1932 | United Kingdom . |
| 0515606 | 1/1940 | United Kingdom . |
| 586961 | 4/1947 | United Kingdom . |

OTHER PUBLICATIONS

D. B. Purchas (Ed.), "Solid/Liquid separation equipment scale-up", Croydon, 1977.

E. S. Perry, C. J. VanOss, E. Grushka (ED)., "Separation and Purification Methods", New York, 1973-1978.

J. Falbe, U. Hasserodt (ed.), "Katalysatoren, Tenside und Mineralöladditive", Thieme Verlag, Stuttgart, 1978.

J. Falbe (ed.) "Sufactants in Consumer Products", Springer Verlag, Berlin, 1986.

Aufbereitungstechnik, 26, 632 (1985).

Deposited Doc. (1975), Vinity 732 (Chem. Abstr. vol. 86:173417v.

Deposited Doc. (1982) SPSTL, 275 (Chem.Abstr. vol. 101).

PROCESS AND RECOVERING MINERALS FROM NON-SULFIDIC ORES BY FLOTATION

FIELD OF THE INVENTION

This invention relates to a process for recovering minerals from non-sulfidic ores by flotation, in which process detergent mixtures containing salts of sulfonated unsaturated fatty acids and sulfonated unsaturated fatty acid glycerol esters, optionally in admixture with other anionic and/or nonionic surfactants, are used as collectors.

STATEMENT OF RELATED ART

Flotation is a separation technique commonly used in the refining of mineral ores for separating valuable minerals from the gangue. Normally, the ore is first size-reduced, dry-ground, but preferably wet-ground and suspended in water. A collector is then normally added, often in conjunction with other reagents, including frothers, regulators, depressors (deactivaters) and/or activators, in order to support separation of the valuable minerals from unwanted gangue minerals of the ore in the subsequent flotation process. These reagents am normally allowed to act on the finely ground ore for a certain time (conditioning) before air is blown into the suspension to produce a froth on its surface and to start the flotation process. The collector hydrophobicizes the surface of the minerals so that they adhere to the gas bubbles formed during the activation step. The mineral constituents are selectively hydrophobicized so that the unwanted constituents of the ore do not adhere to the gas bubbles and remain behind while the mineral-containing froth is stripped off and further processed. In the opposite case, so-called indirect flotation, the gangue is removed by flotation while the valuable mineral remains behind. The object of flotation is to recover the valuable mineral of the ores in as a high yield as possible while at the same time obtaining a high enrichment level of the valuable mineral.

Anionic or cationic surfactants are predominantly used as collectors in the flotation-based refining of ores. The function of these collectors is to adsorb as selectively as possible on the surface of the valuable minerals or the gangue in order to ensure a high enrichment level in the flotation concentrate. In addition, the collectors are intended to develop a buoyant, but not overly stable, flotation froth.

In many cases, however, the collectors typically used in the flotation of non-sulfidic ores, particularly iron ores, such as for example fatty acids, alkyl sulfosuccinates [*Aufbereitungstechnik* [English translation: Refining Technology], 26, 632 (1985)] or oleyl sulfates [DE-OS 1 029 761], do not provide a satisfactory flotation result when used in economically acceptable quantities. In addition, where oleic sulfonate—known from the Russian documents *Deposited Doc.* (1975), VINITY 732 (reported in *Chem. Abstr.* Vol. 86:173427v) and *Deposited Doc.* (1982) SPSTL, 275 (reported in *Chem. Abstr.* Vol. 101:9527p)—is used as collector, there is the disadvantage of excessive frothing.

DESCRIPTION OF THE INVENTION

Object and Summary of the Invention

Accordingly, the problem addressed by the present invention was to provide collector systems which would be free from the disadvantages mentioned above. The present invention relates to a process for recovering minerals from non-sulfidic ores by flotation, in which crushed ore is mixed with water to form a suspension, air is introduced into the suspension in the presence of a reagent system and the froth formed is separated off together with the floated solids present therein, and in which the collectors used are detergent mixtures containing:

a) salts of sulfonation products of unsaturated fatty acids corresponding to formula (I):

$$R^1C(O)—OH \quad (I)$$

in which WC(O) is a linear or branched aliphatic acyl radical containing 12 to 24 carbon atoms and 1 to 5 double bonds, and b) salts of sulfonation products of unsaturated fatty acid glycerol esters corresponding to formula (II):

$$\begin{array}{l} CH_2O—C(O)R^2 \\ | \\ CH—O—C(O)R^3 \\ | \\ CH_2O—C(O)R^4 \end{array} \quad (II)$$

in which $R^2C(O)$ is a linear or branched aliphatic acyl radical containing 12 to 24 carbon atoms and 1 to 5 double bonds and $R^3C(O)$ and $R^4C(O)$ independently of one another represent a linear or branched aliphatic acyl radical containing 6 to 24 carbon atoms and 0 or 1 to 5 double bonds, and, optionally, other anionic and/or nonionic surfactants.

It has surprisingly been found that the detergent mixtures according to the invention produce very little foam in the flotation of non-sulfidic ores so that excessive frothing in the flotation cells can be avoided. The invention includes the observation that the collectors show a high level of activity and selectivity which enables the minerals to be recovered substantially quantitatively for comparatively small quantities of collector, compared with the prior art.

Description of Preferred Embodiments

In one particularly advantageous embodiment, the collectors used are detergent mixtures containing oleic acid sulfonate Na salt as collector component a) and sulfonated new rapeseed oil (oleic acid content >80% by weight) in the form of the sodium salt as collector component b).

In the context of the present invention, non-sulfidic ores are understood to be salt-type minerals, for example fluorite, scheelite, baryta, apatite, iron oxides and other metal oxides, for example the oxides of titanium and zirconium, and also certain silicates and aluminosilicates. The detergent mixtures to be used in accordance with the invention are preferably used for the cleaning of P-containing iron ores.

The salts of the sulfonation products of unsaturated fatty acids are known substances which may obtained by the relevant methods of preparative organic chemistry. To this end, a technical oleic acid, for example, may initially be sulfonated with gaseous sulfur trioxide at temperatures of 15° to 30° C. and subsequently neutralized with aqueous sodium hydroxide solution [DE 4 019 713 Al]. In this reaction, the $SO_3$ molecule largely undergoes electrophilic addition onto one or more double bonds of the unsaturated fatty acid to form internal sulfonic acid functions which are present as sulfonate groups after treatment with the base.

Unsaturated fatty acids corresponding to formula (I):

$$R^1C(O)—OH \quad (I)$$

in which $R^1C(O)$ is a linear or branched aliphatic acyl radical containing 12 to 24 carbon atoms and 1 to 5 double bonds, are suitable starting materials for the preparation of the sulfonation products. Typical examples of these unsaturated fatty acids are palmitoleic acid, oleic acid, elaidic acid, petroselic acid, chaulmoogric acid, linoleic acid, linolenic acid, gadoleic acid, arachidonic acid, erucic acid or clupanodonic acid. Alkali metal salts of the sulfonation products of unsaturated fatty acids corresponding to formula (I), in which $R^1C(O)$ is an acyl radical containing 16 to 22 carbon atoms and 1 double bond, are preferred for use as collectors in the flotation of non-sulfidic ores.

As usual in oleochemistry, the salts of the sulfonation products of unsaturated fatty acids may also be derived from technical fatty acid cuts of the type obtained by the pressure hydrogenation of natural fats and oils, for example sunflower oils, rapeseed oil, coriander oil, chaulmoogra oil, linseed oil, cottonseed oil, peanut oil, beef tallow or fish oil. Salts of sulfonation products of unsaturated fatty acids based on new rapeseed oil (oleic acid content >80% by weight) or beef tallow are preferred.

In the context of the invention, unsaturated fatty acid glycerol esters are understood to be triglycerides which contain at least one unsaturated fatty acid component. The sulfonation products derived therefrom and their salts are also known substances. According to German patent application DE 3 936 001 A1, the products in question can be obtained, for example, by reaction of unsaturated fatty acid glycerol esters with sulfur trioxide and subsequent neutralization. The sulfonation products are complex mixtures which may contain triglyceride sulfonates, partial glyceride sulfonates, partial glyceride sulfates, sulfonated fatty acids, fatty acids and also glycerol. The properties of the sulfonation products are critically determined by the quantity of sulfur trioxide absorbed in the sulfonation reaction. Salts of sulfonation products of unsaturated fatty acid glycerol esters which are obtained by reaction of unsaturated fatty acid glycerol esters with $SO_3$ in a molar ratio of 1:0.95 to 1:2 and, more particularly, 1:1 to 1:1.5 are preferred for the purposes of the invention.

Alkali metal salts of sulfonation products corresponding to formula (II), in which $R^2C(O)$, $R^3C(O)$ and $R^4C(O)$ independently of one another represent linear acyl radicals containing 16 to 22 carbon atoms and 1 double bond, are preferably used in the interests of particularly low foaming of the detergent mixtures to be used in accordance with the invention.

In addition to unsaturated fatty acid glycerol esters of synthetic origin, natural triglycerides having iodine values of 50 to 125 and, more particularly, 85 to 110 are particularly suitable as starting materials for the production of the salts of the sulfonation products. Typical examples of these natural triglycerides are new rapeseed oil and new sunflower oil (oleic acid content >80% by weight), coriander oil, soybean oil, peanut oil, olive oil, cottonseed oil, beef tallow or fish oil.

The detergent mixtures to be used in accordance with the invention may contain the collector components a) and b) in a ratio by weight of 95:5 to 5:95 and preferably in a ratio by weight of 50:50 to 80:20. The collector components a) and b) may be mixed, for example, by stirring, optionally at temperatures of 40° to 50° C., without any chemical reaction. However, the detergent mixtures according to the invention may also be prepared by mixing the unsaturated fatty acids and the unsaturated fatty acid glycerol esters in the desired ratio and subjecting the resulting mixture to sulfonation and subsequent neutralization.

In one preferred embodiment of the invention, therefore, detergent mixtures containing components a) and b), which are obtained by the co-sulfonation of unsaturated fatty acids corresponding to formula (I) and unsaturated fatty acid glycerol esters corresponding to formula (II), may be used as collectors.

The process according to the invention enables the detergent mixtures to be used as collectors for the recovery of minerals from non-sulfidic ores by flotation either on their own or in the presence of other anionic and/or nonionic surfactants.

In the context of the invention, anionic surfactants are understood to be fatty acids, alkyl sulfates, alkyl ether sulfates, alkyl sulfosuccinates, alkyl sulfosuccinamates, alkyl benzenesulfonates, alkyl sulfonates, petroleum sulfonates, acyl lactates, sarcosides, alkyl phosphates and alkyl ether phosphates. These anionic surfactants are all known compounds of which the production—unless otherwise stated—is described, for example, in J. Falbe, U. Hasserodt (ed.), *Katalysatoren, Tenside und Mineralol-additive* [English translation: Catalysts, Surfactants, and Mineral Oil Additives] (Thieme Verlag, Stuttgart, 1978) or J. Falbe (ed.), *Surfactants in Consumer Products* (Springer Verlag, Berlin, 1986).

Suitable fatty acids are, above all, the linear fatty acids obtained from vegetable or animal fats and oils, for example by lipolysis and, optionally, fractionation and/or separation by the rewetting process, corresponding to formula (III):

$$R^5C(O)OY \quad (III),$$

in which $R^5$ is an aliphatic hydrocarbon radical containing 12 to 18 carbon atoms and 0, 1, 2 or 3 double bonds and Y is an alkali or alkaline earth metal or an ammonium group. Particular significance is attributed in this regard to the sodium and potassium salts of oleic acid and tall oil fatty acid.

Suitable alkyl sulfates are the water-soluble salts of sulfuric acid semiesters of fatty alcohols corresponding to formula (IV):

$$R^6—O—SO_3Z \quad (IV),$$

in which $R^6$ is a linear or branched alkyl radical containing 8 to 22 and preferably 12 to 18 carbon atoms and Z is an alkali metal or an ammonium group.

Suitable alkyl ether sulfates are the water-soluble salts of sulfuric acid semiesters of fatty alcohol polyglycol ethers corresponding to formula (V):

$$R^7—(OCH_2\overset{\overset{R^8}{|}}{C}H)_nOSO_3Z, \quad (V)$$

in which $R^7$ is a linear or branched alkyl radical containing 8 to 22 and preferably 12 to 18 carbon atoms, $R^8$ is hydrogen or a methyl group, n=1 to 30 and preferably 2 to 15 and Z is as defined above.

Suitable alkyl sulfosuccinates are sulfosuccinic acid monoesters of fatty alcohols corresponding to formula (VI):

$$R^9-O(O)C-CH_2-\underset{\underset{SO_3Z}{|}}{CH}-C(O)\,OZ, \quad (VI)$$

in which $R^9$ is a linear or branched alkyl radical containing 8 to 22 and preferably 12 to 18 carbon atoms and Z is as defined above.

Suitable alkyl sulfosuccinamates are sulfosuccinic acid monoamides of fatty amines corresponding to formula (VII):

$$R^{10}-NH-(O)C-CH_2-\underset{\underset{SO_3Z}{|}}{CH}-C(O)OZ, \quad (VII)$$

in which $R^{10}$ is a linear or branched alkyl radical containing 8 to 22 and preferably 12 to 18 carbon atoms and Z is as defined above.

Suitable alkyl benzenesulfonates are compounds corresponding to formula (VIII):

$$R^{11}-C_6H_4-SO_3Z \quad (VIII),$$

in which $R^{11}$ is a linear or branched alkyl radical containing 4 to 16 and preferably 8 to 12 carbon atoms and Z is as defined above.

Suitable alkyl sulfonates are compounds corresponding to formula (IX):

$$R^{12}-SO_3Z \quad (IX)$$

in which $R^{12}$ is a linear or branched alkyl radical containing 12 to 18 carbon atoms and Z is as defined above.

Suitable petroleum sulfonates are compounds obtained by reaction of lubricating oil fractions with sulfur trioxide or oleum and subsequent neutralization with sodium hydroxide. Products in which the hydrocarbon radicals predominantly have chain lengths of 8 to 22 carbon atoms are particularly suitable.

Suitable acyl lactylates are compounds corresponding to formula (X):

$$R^{13}-C(O)-O-\overset{\overset{CH_3}{|}}{CH}-C(O)OZ, \quad (X)$$

in which $R^{13}$ is an aliphatic, cycloaliphatic or alicyclic, optionally hydroxyl-substituted hydrocarbon radical containing 7 to 23 carbon atoms and 0, 1, 2 or 3 double bonds and Z is as defined above. The production and use of acyl lactylates in flotation is described in DE-A-32 38 060.

Suitable sarcosides are compounds corresponding to formula (XI):

$$R^{14}-C(O)-\overset{\overset{CH_3}{|}}{N}-CH_2-C(O)OH, \quad (XI)$$

in which $R^{14}$ is an aliphatic hydrocarbon radical containing 12 to 22 carbon atoms and 0, 1, 2 or 3 double bonds.

Suitable alkyl phosphates and alkyl ether phosphates are compounds corresponding to formulas (XII) and (XIII):

$$R^{15}-(OCH_2CH_2)_pO-\overset{\overset{O}{\|}}{\underset{\underset{OZ}{|}}{P}}-OZ, \quad (XII)$$

and $$R^{15}-(OCH_2CH_2)_pO-\overset{\overset{O}{\|}}{\underset{\underset{OZ}{|}}{P}}-O(CH_2CH_2O)_q-R^{16}, \quad (XII)$$

in which $R^{15}$ and $R^{16}$ independently of one another represent an alkyl or alkenyl radical containing 8 to 22 carbon atoms, p and q=0 in the case of the alkyl phosphates and =1 to 15 in the case of the alkyl ether phosphates and Z is as defined above.

If the salts to be used in accordance with the invention are used in admixture with alkyl phosphates or alkyl ether phosphates, the phosphates may be present as mono- or di-phosphates. In this case, mixtures of mono- and dialkyl phosphates of the type obtained in the industrial production of such compounds are preferably used.

In the context of the invention, nonionic surfactants are understood to be fatty alcohol polyglycol ethers, alkylphenol polyglycol ethers, fatty acid polyglycol esters, fatty acid amide polyglycol ethers, fatty amine polyglycol ethers, mixed ethers, hydroxy mixed ethers and alkyl glycosides. These nonionic surfactants are all known compounds of which the production—unless otherwise stated—is described in J. Falbe, U. Hasserodt (eds.), *Katalysatoren, Tenside und Mineraloladditive* (Thieme Verlag, Stuttgart, 1978) or J. Falbe (ed.), *Surfactants in Consumer Products* (Springer Verlag, Berlin, 1986).

Suitable fatty alcohol polygcol ethers are adducts of, on average, n moles of ethylene and/or propylene oxide with fatty alcohols which correspond to formula (XIV):

$$R^{17}(OCH_2\overset{\overset{R^8}{|}}{C}H)_nOH \quad (XIV)$$

in which $R^{17}$ is a linear or branched alkyl radical containing 8 to 22 and preferably 12 to 18 carbon atoms, $R^8$ is hydrogen or a methyl group and n is a number of 1 to 30 and preferably 2 to 15.

Suitable alkylphenol polyglycol ethers are adducts of, on average, n moles of ethylene and/or propylene glycol with alkylphenols which correspond to formula (XV)

$$R^{18}-C_6H_4-(OCH_2\overset{\overset{R^8}{|}}{C}H)_nOH, \quad (XV)$$

in which $R^{18}$ is an alkyl radical containing 4 to 15 and preferably 8 to 10 carbon atoms and $R^8$ and n are as defined above.

Suitable fatty acid polyglycol esters are adducts of, on average, n moles of ethylene and/or propylene oxide with fatty acids which correspond to formula (XVI):

$$R^{19}-C(O)(OCH_2\overset{\overset{R^8}{|}}{C}H)_nOH, \quad (XVI)$$

in which $R^{19}$ is an aliphatic hydrocarbon radical containing 5 to 21 carbon atoms and 0, 1, 2 or 3 double bonds and $R^8$ and n are as defined above.

Suitable fatty acid amide polyglycol ethers are adducts of, on average, n moles of ethylene and/or propylene oxide with fatty acid amides which correspond to formula (XVII):

$$R^{20}-C(O)-NH(OCH_2\overset{\overset{R^8}{|}}{C}H)_nOH, \quad (XVII)$$

in which $R^{20}$ is an aliphatic hydrocarbon radical containing 5 to 21 carbon atoms and 0, 1, 2 or 3 double bonds and $R^8$ and n are as defined above.

Suitable fatty amine polyglycol ethers are adducts of, on average, n moles of ethylene and/or propylene oxide with fatty amines which correspond to formula (XVIII):

$$R^{21}-NH(OCH_2\overset{\overset{R^8}{|}}{C}H)_nOH, \quad (XVIII)$$

in which $R^{21}$ is an alkyl radical containing 6 to 22 carbon atoms and $R^8$ and n are as defined above.

Suitable mixed ethers are reaction products of fatty alcohol polyglycol ethers with alkyl chlorides corresponding to formula (XIX):

$$R^{22}-(OCH_2\overset{\overset{R^8}{|}}{C}H)_n-O-R^{23}, \quad (XIX)$$

in which $R^{22}$ is an aliphatic hydrocarbon radical containing 6 to 22 carbon atoms and 0, 1, 2 or 3 double bonds, $R^{23}$ is an alkyl radical containing 1 to 4 carbon atoms or a benzyl radical and $R^8$ and n are as defined above.

Suitable hydroxy mixed ethers are compounds corresponding to formula (XX):

$$R^{24}-\overset{\overset{OH}{|}}{C}H-CH_2-(OCH_2\overset{\overset{R^8}{|}}{C}H)_n-O-R^{25}, \quad (XX)$$

in which $R^{24}$ is an alkyl radical containing 6 to 16 carbon atoms, $R^{25}$ is an alkyl radical containing 1 to 4 carbon atoms and $R^8$ and n are as defined above. The production of the hydroxy mixed ethers is described in German patent application DE 3 723 323 A1.

Suitable alkyl glycosides are compounds corresponding to formula (XXI):

$$R^{26}-O-(G)_X \quad (XXI),$$

in which G is a glycose unit derived from a sugar containing 5 or 6 carbon atoms, x is a number of 1 to 10 and $R^{26}$ is an aliphatic hydrocarbon radical containing 6 to 22 carbon atoms and 0, 1, 2 or 3 double bonds. G is preferably a glucose unit and x is a number of 1.1 to 1.6. The production of the alkyl glycosides is described, for example, in German patent application DE 3 723 826 A1.

In cases where the collector components a) and b) are not used on their own, but in admixture with other anionic and/or nonionic surfactants, the mixtures advantageously have a total content of 5 to 95% by weight and preferably 10 to 60% by weight of salts of the sulfonation products of unsaturated fatty acids and salts of the sulfonation products of unsaturated fatty acid glycerol esters.

To obtain economically useful results in the flotation of non-sulfidic ores, the detergent mixtures have to be used in certain minimum quantities. At the same time, however, a maximum quantity of surfactant mixture must not be exceeded because otherwise frothing would become too intensive and selectivity towards the valuable minerals would decrease.

The quantities in which the detergent mixtures to be used in accordance with the invention or mixtures thereof with other anionic and/or nonionic surfactants are used are dependent upon the type of ores to be flotated and upon their content of valuable minerals. Accordingly, the particular quantities required can vary within wide limits. In general, the detergent mixtures to be used in accordance with the invention of salts of the sulfonation products of unsaturated fatty acids and salts of the sulfonation products of unsaturated fatty acid glycerol esters or mixtures thereof with anionic and/or nonionic surfactants are used in quantities of 50 to 2,000 g per tonne of crude ore and preferably in quantities of 100 to 1,500 g per tonne of crude ore.

The process according to the invention includes the use of typical flotation reagents such as, for example, frothers, regulators, activators, deactivators, etc. Flotation is carried out under the same conditions as known processes. In this connection, information on the technological background to the refining of ores can be found in the following literature references: H. Schubert, *Aufbereitung fester mineralischer Stoffe* [English translation: Refining of Solid Mineral Substances] (Leipzig, 1967); D. B. Puchas (Ed.), *Solid/Liquid Separation Equipment Scale-Up* (Croydon, 1977); E. S. Perry, C. J. VanOss, E. Grushka (Eds.), *Separation and Purification Methods* (New York, 1973–1978).

The following Examples are intended to illustrate the invention.

EXAMPLES

I. Production of the collectors used

Mixture of oleic acid sulfonate/sulfonated rapeseed oil, Na salts (collector A)

a) 196 g (0.7 mole) of technical oleic acid (Edenor® A-TiO5, iodine value 91, molecular weight 280, a product of Henkel KGaA) was introduced into a 1 liter sulfonation reactor with jacket cooling and a gas inlet pipe and reacted at 15° C. with 56 g (0.7 mole) of gaseous sulfur trioxide. The sulfur trioxide was driven out by heating from a corresponding quantity of 65% by weight oleum, diluted to a concentration of 5% by volume and introduced into the starting product over a period of 20 minutes. On completion of the sulfonation reaction, the acidic reaction mixture was stirred at 60° C. into aqueous 50% by weight sodium hydroxide solution and thus neutralized. The product was present in the form of a clear, low-viscosity liquid.

b) 267 g (0.3 mole) of new rapeseed oil (oleic acid content >80% by weight, molecular weight 889) were reacted at 60° C. with 0.36 g (0.45 mole) of sulfur trioxide as described in a). On completion of the sulfonation reaction, the acidic reaction mixture was stirred at 60° C. into aqueous 50% by weight sodium hydroxide solution and thus neutralized. The product was present in the form of a clear, low-viscosity liquid.

Components a) and b) were then mixed together by stirring at ambient temperature. The characteristic data of the product are set out in Table 1.

TABLE 1

| Characteristic data of the collectors used | | | | | |
|---|---|---|---|---|---|
| Collector | WAS % | US % | $SO_4$ % | $H_2O$ % | Viscosity mPa · s |
| A | 40 | 12 | 2 | 46 | 400 |
| B | 41 | 11 | 2 | 46 | 20 |
| C | 45 | 7 | 3 | 45 | 300 |

Mixture of oleic acid sulfonate/sulfonated rapeseed oil, Na salts (collector B)

1,000 g of a mixture containing a) technical oleic acid (as in A)

b) new rapeseed oil (as in A)

in a ratio by weight of 70:30 were introduced into a continuous falling-film reactor (length 120 cm, cross-section 1 cm, educt throughput 600 g/h) with jacket cooling and a lateral $SO_3$ inlet and reacted at 60° C. with a mixture of sulfur trioxide and nitrogen ($SO_3$ concentration: 5% by volume). The quantity of $SO_3$ was gauged in such a way that there was 1 mole of sulfur trioxide per mole of oleic acid and 1.2 moles of sulfur trioxide per mole of rapeseed oil.

The acidic reaction mixture was continuously introduced into 50% by weight sodium hydroxide solution at 70° C. and neutralized. The characteristic data of the product are set out in Table 1.

Oleic acid sulfonate, Na salt (collector C)

Collector C was produced in the same way as component a) of collector A. The characteristic data of the product are set out in Table 1.

The anionic surfactant content (WAS) and the unsulfonated components (US) were determined by the DGF-*Einheirsmethoden* (Stuttgart 1950–1984) H-III-10 and G-II-6b. The sulfate content was calculated as sodium sulfate, the water content was determined by the Fischer method. Viscosity was determined by the Brookfield method at 20° C.

II Flotation tests in a Denver cell

Examples 1 and 2; Comparison Example CI:

Flotation of Iron ore

The floatation feed was a magnetically enriched iron ore of the magnetite type having the following composition, based on its principal constituents:

Magnetite: about 96% by weight

Apatite: about 1% by weight

Silicates: about 3% by weight

The flotation feed had the following particle distribution:

−45 μm: 87% by weight

45−74 μm: 12% by weight

>74 μm: 1% by weight

Collectors A (mixture of oleic acid sulfonate, Na salt, and sulfonated rapeseed oil, Na salt) and B (sulfonated mixture of oleic acid and rapeseed oil in the form of the sodium salt) according to the invention were used. Collector C (oleic acid sulfonate, Na salt) was used for comparison.

Flotation was carried out in the 4 liter cell of a Denver type D1 laboratory flotation machine. Water having a hardness of 14° d was used as the flotation water. The density during flotation of the liquid containing solid materials in suspension was about 35% by weight and the temperature of the liquid containing solid materials in suspension was 15° C. Waterglass in a quantity of 75 g/t was used as depressor. The pH value of the liquid containing solid materials in suspension was adjusted with sodium hydroxide to 8.5.

The reagents were conditioned with stirring at a rotational speed of 1,000 r.p.m. The conditioning time was 5 minutes both for the depressor and for the collector. Flotation was carried out at a rotational speed of 1,100 r.p.m. The flotation time was about 7 minutes, during which the flotation froth was manually removed. The process of indirect flotation for P reduction was applied. The results are set out in Table 2.

TABLE 2

| Flotation of iron ore in a Denver cell; percentages as % by weight | | | | | | | | |
|---|---|---|---|---|---|---|---|---|
| Ex. | Collector | QU g/t | Product | Q % | G1 % | G2 % | A1 % | A2 % |
| 1 | A | 84 | Fe-Conc. | 94.4 | 71.7 | 0.032 | 96.3 | 10.6 |
| | | | Froth pr. | 5.6 | 46.4 | 4.549 | 3.7 | 89.4 |
| | | | Feed | 100.0 | 70.3 | 0.290 | 100.0 | 100.0 |
| 2 | B | 59 | Fe-Conc. | 94.6 | 71.2 | 0.028 | 96.5 | 9.3 |
| | | | Froth pr. | 5.4 | 45.1 | 4.799 | 3.5 | 90.7 |
| | | | Feed | 100.0 | 69.8 | 0.290 | 100.0 | 100.0 |
| 3 | B | 67 | Fe-Conc. | 91.5 | 69.7 | 0.028 | 93.2 | 8.9 |
| | | | Froth pr. | 8.5 | 54.7 | 3.087 | 6.8 | 91.1 |
| | | | Feed | 100.0 | 68.4 | 0.290 | 100.0 | 100.0 |
| C1 | C | 86 | Fe-Conc. | 93.5 | 72.6 | 0.025 | 95.6 | 7.7 |
| | | | Froth pr. | 6.5 | 47.9 | 4.287 | 4.4 | 92.3 |
| | | | Feed | 100.0 | 71.0 | 0.300 | 100.0 | 100.0 |

Legend:
QU = quantity used, based on active substance
Q = quantity
G1 = Fe content
G2 = P content
A1 = Fe recovery
A2 = P recovery
Fe conc. = magnetite concentrate
Froth pr. = froth product

The invention claimed is:

1. In a process for the selective separation and recovery of minerals from a non-sulfidic ore containing said minerals in which said ore is crushed and is mixed with water and a collector for said minerals to form a suspension, subjecting the suspension to flotation by introducing air into the suspension in the presence of said collector and forming a froth which selectively includes said minerals and recovering the minerals therefrom wherein the improvement comprises said collector containing the sodium salts of the reaction products of(a) oleic acid and (b) new rapeseed oil in a ratio by weight of 70:30 to 80:20 with sulfur trioxide, optionally together with another surfactant selected from the group consisting of anionic surfactants, nonionic surfactants and mixtures thereof.

2. A process as claimed in claim 1, wherein the collector comprises anionic surfactants selected from the group consisting of fatty acids, alkylsulfates, alkyl ether sulfates, alkyl sulfosuccinates, alkyl succinamates, alkylbenzenesulfonates, alkylsulfonates, petroleum sulfonates, acyl lactylates, sarcosides, alkyl phosphates and alkyl ether phosphates, all in the form of salts.

3. A process as claimed in claim 2, wherein the collector comprises nonionic surfactants selected from the group consisting of fatty alcohol polyglycol ethers, alkylphenol polyglycol ethers, fatty acid polyglycol esters, fatty acid amide polyglycol ethers, fatty amine polyglycol ethers, mixed ethers, hydroxy mixed ethers and alkyl glycosides.

4. A process as claimed in claim is 1 wherein the collector comprises from 5 to 95% by weight of the sodium salts of the reaction products of oleic acid and new rapeseed oil.

5. A process as claimed in claim 4, wherein the collectors are used in quantities of 50 to 2,000 g/t of crushed ore.

6. A process as claimed in claim 5 wherein said non-sulfide ore is an iron ore.

7. A process as claimed in claim 1, wherein the collector comprises nonionic surfactants selected from the group consisting of fatty alcohol polyglycol ethers, alkylphenol polyglycol ethers, fatty acid polyglycol esters, fatty acid amide polyglycol ethers, fatty amine polyglycol ethers, mixed ethers, hydroxy mixed ethers and alkyl glycosides.

8. A process as claimed in claim 7, wherein the collector comprises from 5 to 95% by weight of the sodium salts of the reaction products of oleic acid and new rapeseed oil.

9. A process as claimed in claim 2, wherein the collector comprises from 5 to 95% by weight of the sodium salts of the reaction products of oleic acid and new rapeseed oil.

10. A process as claimed in claim 1, wherein the collector comprises from 5 to 95% by weight of the sodium salts of the reaction products of oleic acid and new rapeseed oil.

11. A process as claimed in claim 3, wherein the collectors are used in quantities of 50 to 2,000 g/t of crushed ore.

12. A process as claimed in claim 2, wherein the collectors are used in quantities of 50 to 2,000 g/t of crushed ore.

13. A process as claimed in claim 1, wherein the collectors are used in quantities of 50 to 2,000 g/t of crushed ore.

14. A process as claimed in claim 11 wherein said non-sulfide ore is an iron ore.

15. A process as claimed in claim 9 wherein said non-sulfide ore is an iron ore.

16. A process as claimed in claim 8 wherein said non-sulfide ore is an iron ore.

17. A process as claimed in claim 4 wherein said non-sulfide ore is an iron ore,

18. A process as claimed in claim 3 wherein said non-sulfide ore is an iron ore.

19. A process as claimed in claim 2 wherein said non-sulfide ore is an iron ore.

20. A process as claimed in claim 1 wherein said non-sulfide ore is an iron ore.

* * * * *

UNITED STATES PATENT AND TRADEMARK OFFICE

CERTIFICATE OF CORRECTION

PATENT NO. : 5,441,156
DATED : August 15, 1995
INVENTOR(S) : Bernd Fabry, et. al.

It is certified that error appears in the above-indentified patent and that said Letters Patent is hereby corrected as shown below:

Title page, item [54] and col. 1, line 1, delete "and" and insert --for--.

Signed and Sealed this

Twenty-seventh Day of August, 1996

*Attest:*

Bruce Lehman

BRUCE LEHMAN

*Attesting Officer*

*Commissioner of Patents and Trademarks*

--